US006470613B1

(12) United States Patent
Wildrick

(10) Patent No.: US 6,470,613 B1
(45) Date of Patent: Oct. 29, 2002

(54) LABEL HOLDER FOR SHELF CHANNELS

(75) Inventor: Richard J. Wildrick, Hunlock Creek, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 09/706,652

(22) Filed: Nov. 6, 2000

(51) Int. Cl.[7] ..... G09F 3/18
(52) U.S. Cl. ..... 40/661.03; 40/649; 40/658
(58) Field of Search ..... 40/661.03, 642.02, 40/649, 658, 666; 248/231.81

(56) References Cited

U.S. PATENT DOCUMENTS

| | | | | | |
|---|---|---|---|---|---|
| 4,426,797 | A | * | 1/1984 | Burkemper et al. | 40/661.03 |
| 5,263,269 | A | * | 11/1993 | Tjarnlund | 40/649 |
| 5,473,833 | A | * | 12/1995 | Ostrovsky | 40/642 |
| 5,488,793 | A | * | 2/1996 | Gebka et al. | 40/649 |
| 5,899,011 | A | | 5/1999 | Brinkman | |
| 6,026,603 | A | * | 2/2000 | Kump et al. | 40/661.03 |
| D425,566 | S | * | 5/2000 | Mueller et al. | D20/43 |
| 6,105,295 | A | | 8/2000 | Brinkman et al. | |
| 6,189,248 | B1 | * | 2/2001 | Nagel et al. | 40/661.03 |
| D443,311 | S | * | 6/2001 | Wildrick | D20/43 |
| 6,263,603 | B1 | * | 7/2001 | Wildrick | 40/661 |
| 6,266,906 | B1 | * | 7/2001 | Nagel | 40/661.03 |

* cited by examiner

*Primary Examiner*—Jack Lavinder
*Assistant Examiner*—James M. Hewitt
(74) *Attorney, Agent, or Firm*—Schweitzer Cornman Gross & Bondell LLP

(57) ABSTRACT

A label holder for mounting on a shelf channel having an intermediate portion with front and rear surfaces and upper and lower forwardly-projecting flanges, has front and back panels and a shelf channel clip extending from the back panel. A base portion of the shelf channel clip extends from a middle point of the back panel. A shelf channel lower flange-engaging projection extends rearwardly from a rear surface of a lower flange-engaging portion and contacts an upper surface of the lower flange of the shelf channel, and is sized and shaped to limit downward movement of the label holder with respect to the shelf channel. A shelf channel rear surface-engaging portion contacts the rear surface of the intermediate portion of the shelf channel at a point between the upper and lower flanges of the shelf channel. A forwardly-facing C-shaped portion of the shelf channel rear surface-engaging portion has an opening facing the rear surface of the intermediate portion of the shelf channel. A guide flange extends rearwardly from an upper end of the C-shaped portion, and forms a converging entry gap with the lower flange-engaging portion. An upper end of the front panel of the label holder is displaceable forwardly from the back panel upon the application of rearward pressure on a lower portion of the label holder to facilitate the insertion and removal of an information label. The shelf channel clip is resiliently deformable to accommodate and mount to shelf channels of various configurations.

4 Claims, 6 Drawing Sheets

LABEL HOLDER FOR SHELF CHANNELS

FIELD OF THE INVENTION

This invention pertains to the field of label holders, and in particular, to label holders for mounting on shelf channels or wire shelves.

BACKGROUND AND SUMMARY OF THE INVENTION

The present invention is directed to label holders for mounting on channels of shelves of gondola shelf units, or other types of shelves. In particular, the invention is directed to an improved label holder which can be mounted upon shelf channels of various configurations and which can be opened simply by applying pressure to a lower portion of the label holder.

Gondola shelving units having arcuate, often integral shelf channels typically depending downwardly from an upper product-supporting surface of the shelf are widely used. The arcuate shelf channels were initially designed with the intention of inserting product information label directly onto or into the channels. However the need has arisen for the individual label holders to be mounted upon the shelves, and in particular onto the shelf channels.

The present invention provides an improved form of label holder mountable on such shelves. The label holder is typically extruded from resilient plastic material and comprises a clear front panel and a back panel joined along a common bottom edge, which form a pocket for holding an information label.

A shelf channel clip extends downwardly from the back panel underneath a lower flange of the shelf channel and contacts a rear surface of the shelf channel, thereby partially encircling the lower portion of the shelf channel. A lower flange-engaging portion of the shelf channel clip includes a shelf channel lower flange-engaging projection, preferably in the form of an integral rib, which projects rearwardly from a rear surface of the lower flange-engaging portion. The projection contacts an upper surface of the lower flange and is sized and shaped to limit the downward movement of the label holder with respect to the shelf channel when the label holder is mounted thereon.

Extending rearwardly from a bottom end portion of the lower flange-engaging portion is a shelf channel rear surface-engaging portion, which contacts the rear surface of the shelf channel at a point between the upper and lower flanges. The shelf channel rear surface-engaging portion includes a forwardly-facing C-shaped portion which has an opening that faces the rear surface of the shelf channel. A guide flange extends rearwardly from an upper end portion of the C-shaped portion, and forms a converging entry gap with the lower flange-engaging portion to assist in the mounting of the label holder onto the shelf channel.

To mount the label holder on the shelf channel, the shelf channel clip is placed over the bottom of shelf channel, the top of the back panel is directed toward a lower surface of the upper flange of the shelf channel, and the label holder is "snapped" or urged onto the shelf channel. During mounting, the shelf channel clip resiliently expands around the bottom of the shelf channel (and lower flange thereof), which is clamped between the C-shaped portion and the lower flange-engaging portion. Thus, the label holder, and in particular, the shelf channel clip thereof, adjusts to shelf channels of various configurations, shapes and sizes.

As the label holder is urged further onto the shelf channel, the projection of the lower flange-engaging portion rides over the lower flange of the shelf channel and rests on the lower flange, in contact with the upper surface thereof. When in the fully mounted position, the top of the back panel contacts and rests against the lower surface of the upper flange and/or a intermediate portion of the shelf channel.

The front panel can be urged open by directing downward and/or rearward pressure (e.g., with a finger) on the bottom of the label holder. This facilitates the insertion and replacement of label within the pocket formed by the front and back panels.

Thus, the label holder of the present invention provides an improved means for mounting and replacing information labels on shelving units having shelf channels and on wire shelves which have no means of labeling. The label holder accommodates shelf channels of various configurations and can be opened simply by applying pressure to a bottom portion of the label holder.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
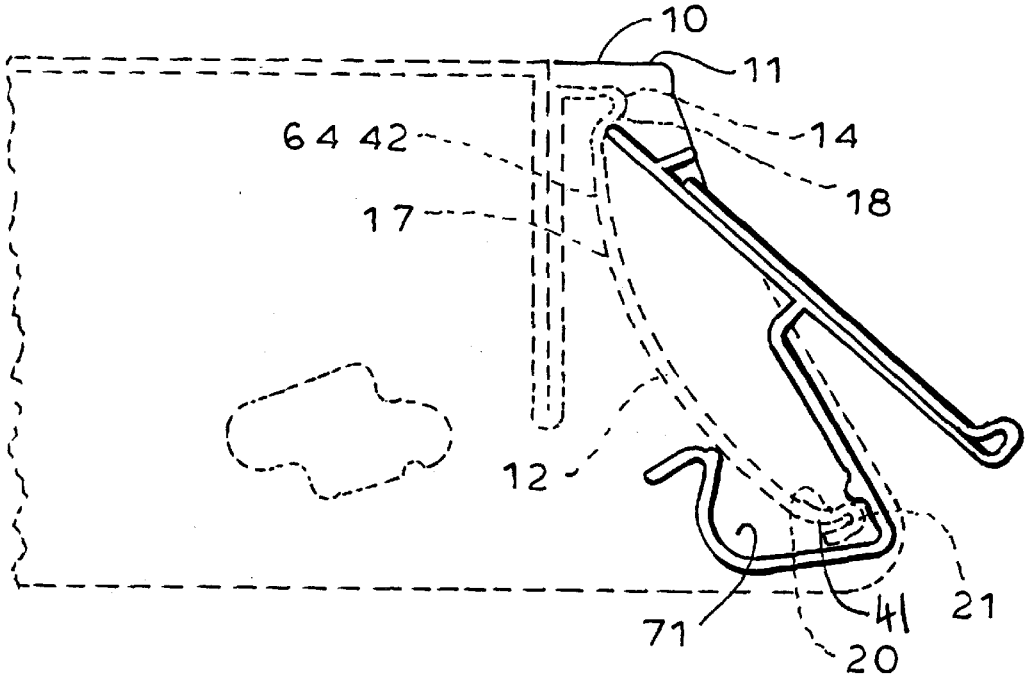
FIG. 1 is a side elevational view of a label holder of the present invention mounted upon a first type of shelf channel.
Figure 2:
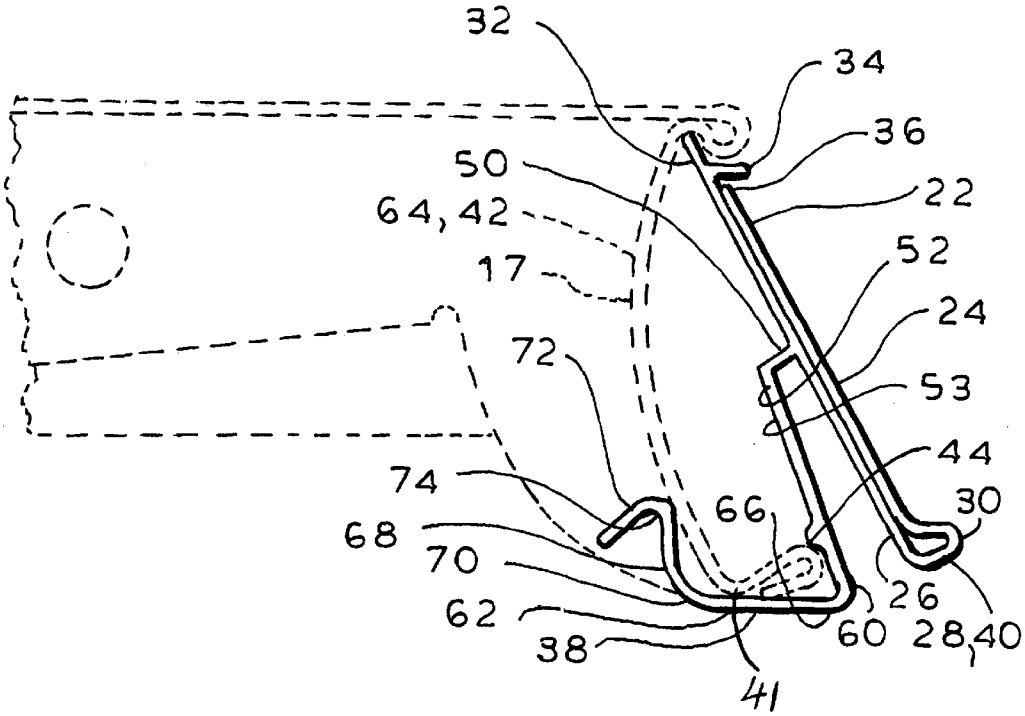
FIG. 2 is a side elevational view of a label holder of the present invention mounted upon a second type of shelf channel.
Figure 3:
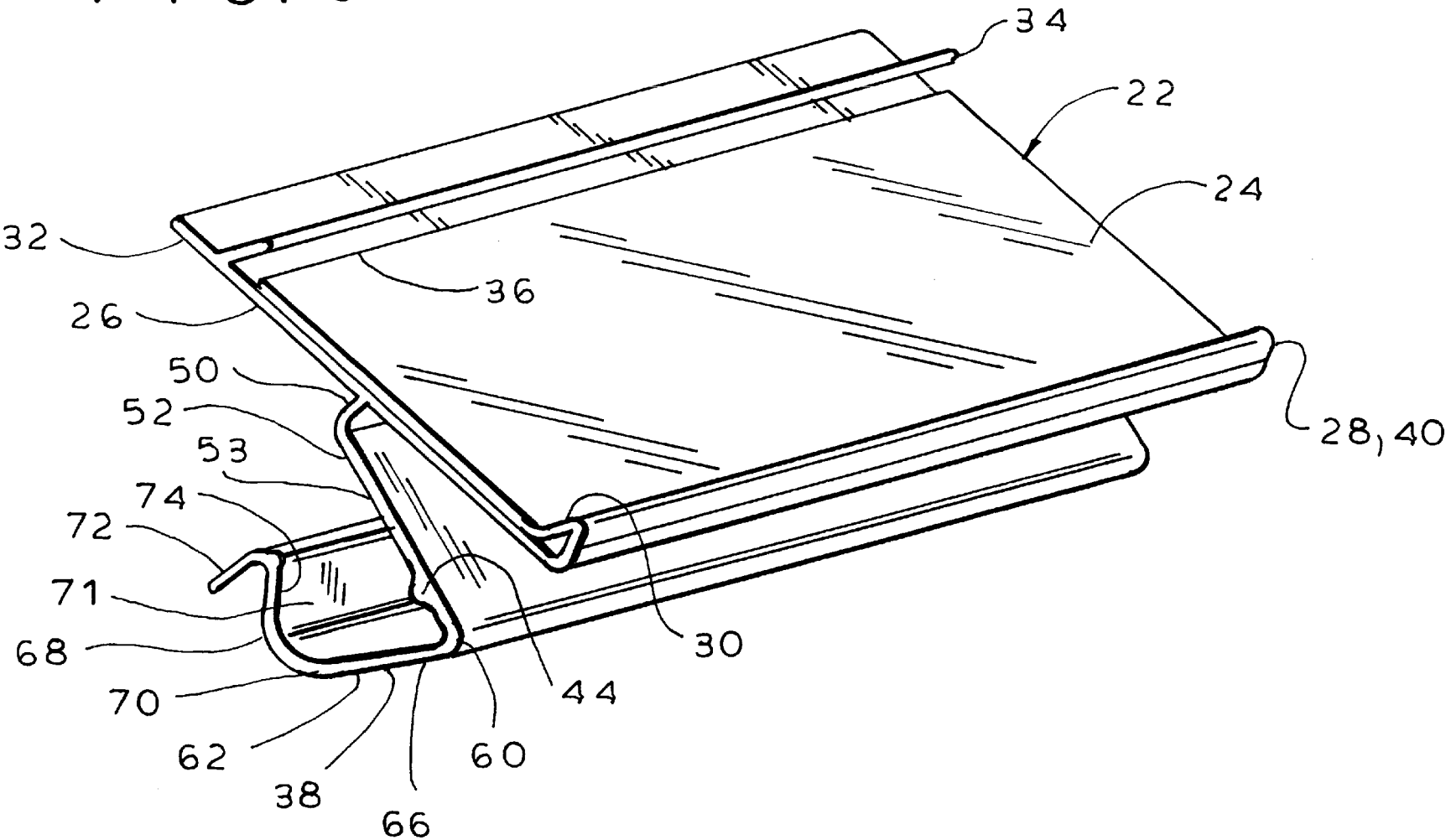
FIGS. 3 and 4 are perspective views of the label holder from the front and rear, respectively.
Figure 4:
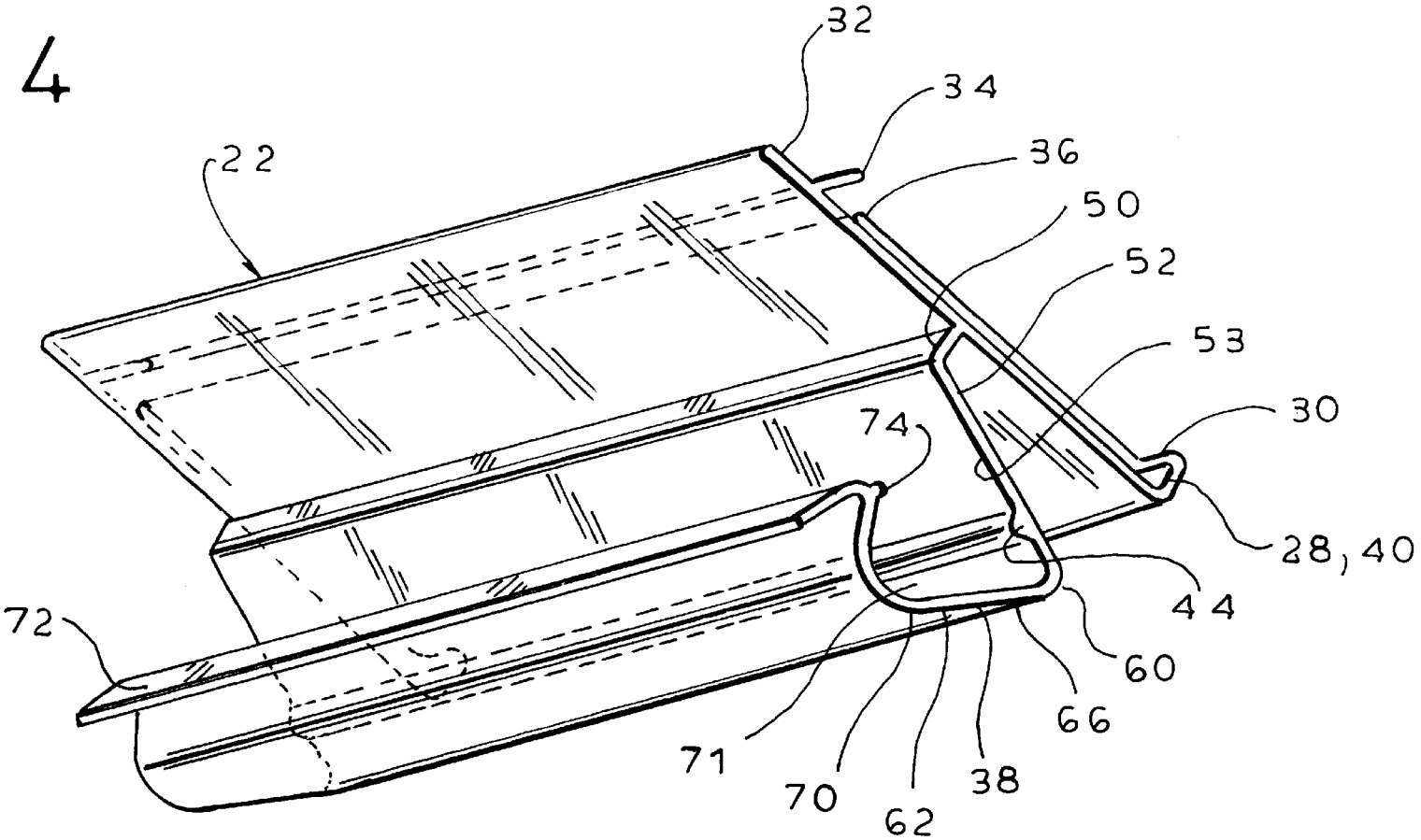
Figure 5:
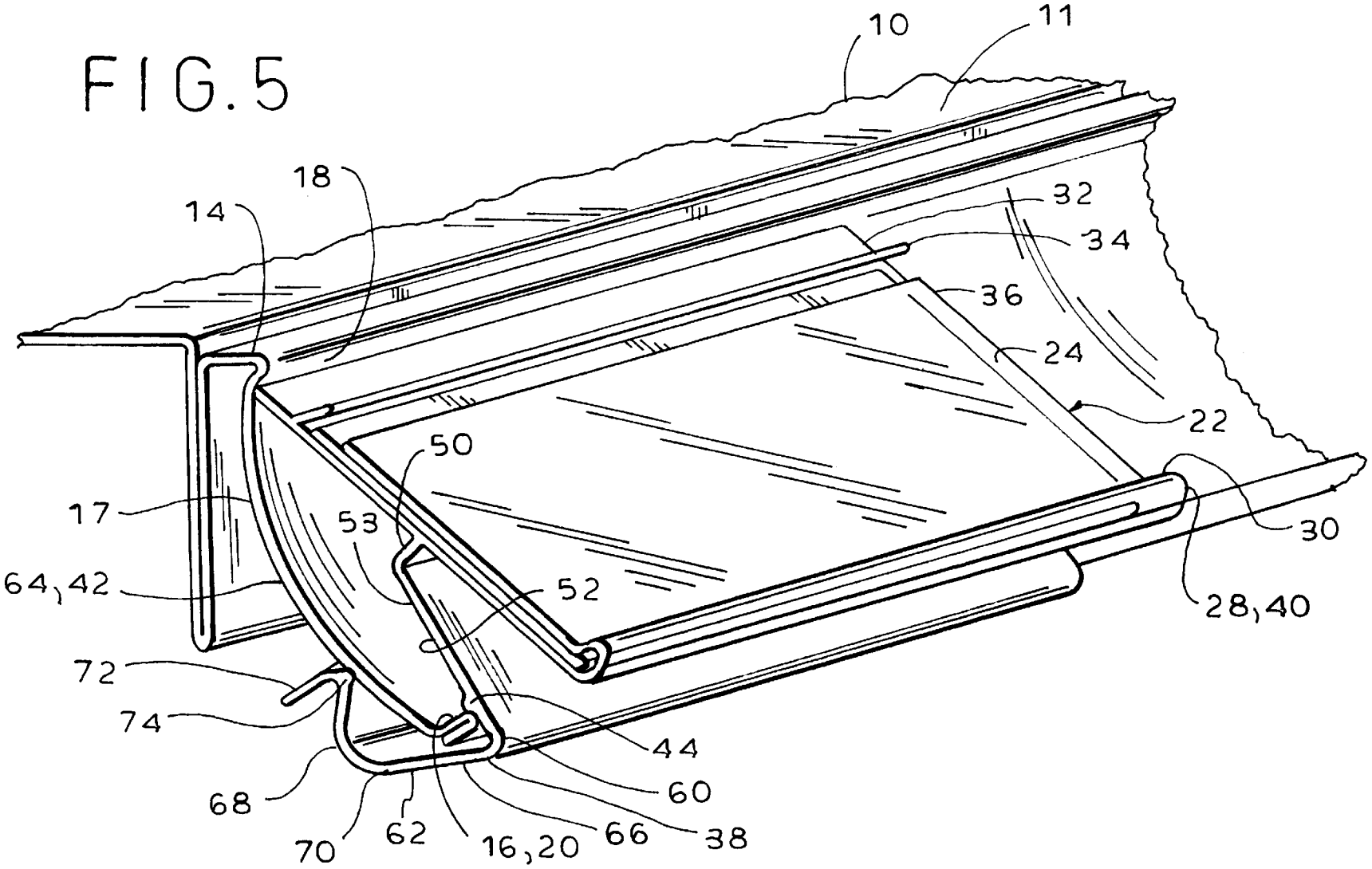
FIG. 5 is a perspective view of the label holder mounted on a shelf channel, from the front.

Referring now to the drawings, and initially to FIGS. 1 and 2 thereof, the reference number 10 designates generally a shelf structure having a top surface 11 and an arcuate, usually inclined shelf channel 12 depending downwardly from the top surface 11. Typically, the shelf 10 is part of a gondola structure (not shown) which is an independent structural unit of about four feet in length, with a plurality of shelves of such length placed at various heights. However, the label holder of the present invention is suitable for other types of shelf structures.

The shelf channel 12 has an upper flange 14 and a lower flange 16, both of which project forwardly from an intermediate portion 17 of the shelf channel 12. The upper and lower flanges 14, 16 define the upper and lower limits of the shelf channel 12, respectively, and the intermediate portion 17 defines the trough of the channel. The upper flange 14 of the shelf channel 12 has a downwardly-facing lower surface 18, which generally faces an upwardly-facing upper surface 20 of the lower flange 16.

As shown, the shelf channel 12 is typically integrally formed with the shelf 10, and the upper and lower flanges 14, 16 and the intermediate portio 17 are integrally formed with one another. The lower flange 16 typically includes an arcuate forward edge 21 formed by a fold in the sheet material forming the shelf channel 12.

Referring to FIGS. 1–5, a label holder, generally designated by the reference number 22, is extruded of a suitable plastic material, such as polyvinyl chloride, in continuous lengths and typically cut to lengths of, for example, 1–3 inches, for installation on gondola shelves.

The label holder 22 comprises front and back panels 24, 26 joined along a common bottom edge 28. A guide flange 30 preferably projects forwardly from a lower portion of the front panel 24 to guide a scanning wand, or the like, to facilitate periodic scanning of a label held within the label holder 22. The panels 24, 26 are preferably quite thin (e.g., 0.025 inches) so as to be capable of being easily flexed. The front panel 24 is formed of clear plastic, while the back panel 16 may, and sometimes preferentially is, co-extruded of opaque material. As formed, the front and back panels 24, 26 normally are biased into contact, or near contact, at the top, and provide a suitable cavity for receiving and retaining and information label. The top 32 of the back panel 26 may be provided with a short protective flange 34, which projects forwardly over the top 36 of the front panel 24 when the label holder 22 is in its normal closed position.

A shelf channel clip 38 extends downwardly from the back panel 26, underneath the lower flange 16 of the shelf channel 12 and contacts a rear surface 42 of the shelf channel 12, thereby partially encircling the lower portion 40 of the shelf channel 12.

A base portion 50 of the shelf channel clip 38 extends rearwardly from the back panel 26 of the label holder 22 from a point above a bottom portion 40 thereof, which point is preferably substantially equidistant the bottom portion 40 of the label holder and the top portion 32 of the back panel 16. The base portion 50 is preferably substantially straight and preferably substantially perpendicular to a plane of the back panel 16.

A lower flange-engaging portion 52 of the shelf channel clip 38 extends downwardly from the base portion 50. The lower flange-engaging portion 52 is preferably substantially straight and extends to a point substantially at or on a plane passing through the bottom portion 28 of the label holder 22 and perpendicular to the back panel 26.

The lower flange-engaging portion 52 includes a shelf channel lower flange-engaging projection 44 which projects rearwardly from a rear surface 53 of the lower flange-engaging portion 52. The projection 44 contacts an upper surface 20 of the lower flange 16 and, optionally, the arcuate forward edge 21 of the lower flange 16 of the shelf channel 12. The projection 44 is sized and shaped to limit the downward movement of the label holder 22 with respect to the shelf channel 12 when the label holder 22 is mounted thereon. The projection 44 is preferably in the form of an integral semi-circular or triangular rib, which can be integrally formed or co-extruded with the remainder of the shelf channel clip 38, which rib 45 extends the horizontal length of the label holder 22.

Extending rearwardly from a bottom end portion 60 of the lower flange-engaging portion 52 is a shelf channel rear surface engaging portion 62, which contacts the rear surface 64 of the intermediate portion 17 of the shelf channel 12 at a point between the upper and lower flanges 14, 16 of the shelf channel 12. The shelf channel rear surface engaging portion 62 includes a rearwardly depending portion 66, which extends rearwardly from the bottom end portion 60 of the lower flange-engaging portion 52, and is preferably substantially straight.

A forwardly-facing, arcuate C-shaped portion 68 is connected to a rearward end 70 of the rearwardly depending portion 66, which C-shaped portion 68 has an opening 71 which faces the rear surface 64 of the shelf channel 12 (and faces the back panel 16 of the label holder 22). A guide flange 72 extends rearwardly from an upper end portion 74 of the C-shaped portion 68. In a rest position (i.e., unmounted), the guide flange 72 forms a converging entry gap with the lower flange-engaging portion 52, to assist in the mounting of the label holder 22 onto the shelf channel 12.

To mount the label holder 22 on the shelf channel 12, the shelf channel clip 38 is placed over the bottom of shelf channel 12, the top 36 of the back panel 16 is directed toward the lower surface 18 of the upper flange 12 of the shelf channel 12, and the label holder 22 is "snapped" or urged onto the shelf channel.

During mounting, the C-shaped portion 68, and the junction between the shelf channel rear surface engaging portion 62 and the lower flange-engaging portion 52, resiliently expand around the bottom portion and lower flange 16 of the shelf channel 12, which are clamped between the upper end portion 74 of the C-shaped portion 68 and the lower flange-engaging portion 52. Thus, the label holder 22, and in particular, the shelf channel clip 38 thereof, adjusts to shelf channels of various configurations, shapes and sizes. In particular, the label holder 22 adjusts to and is mountable upon shelf channels commonly known as "Streater" (FIG. 1) and "Lozier" (FIG. 2) types.

As the label holder 22 is urged further onto the shelf channel 12, the projection 44 of the lower flange-engaging portion 52 rides over the lower flange 16 of the shelf channel 12 and rests on the lower flange 16, in contact with the upper surface 20, and preferably the arcuate front edge 21, thereof. When in the fully mounted position, the top 32 of the back panel 26 contacts and rests against the lower surface 18 of the upper flange 14 and/or against the intermediate portion 17. Thus, the label holder 22 contacts the shelf channel 12 along three lines of contact, namely (1) the top 32 of the back panel 26 contacts the lower surface of the 18 of the upper flange 14 (and/or the intermediate portion 17), (2) the projection 44 of the lower flange-engaging portion 52 contacts the lower flange 16 (and sometimes the arcuate forward edge 21 thereof), and (3) the upper end portion 74 of the C-shaped portion 68 contacts the rear surface 64 of the intermediate portion 17 of the shelf channel 12.

Figure 6:
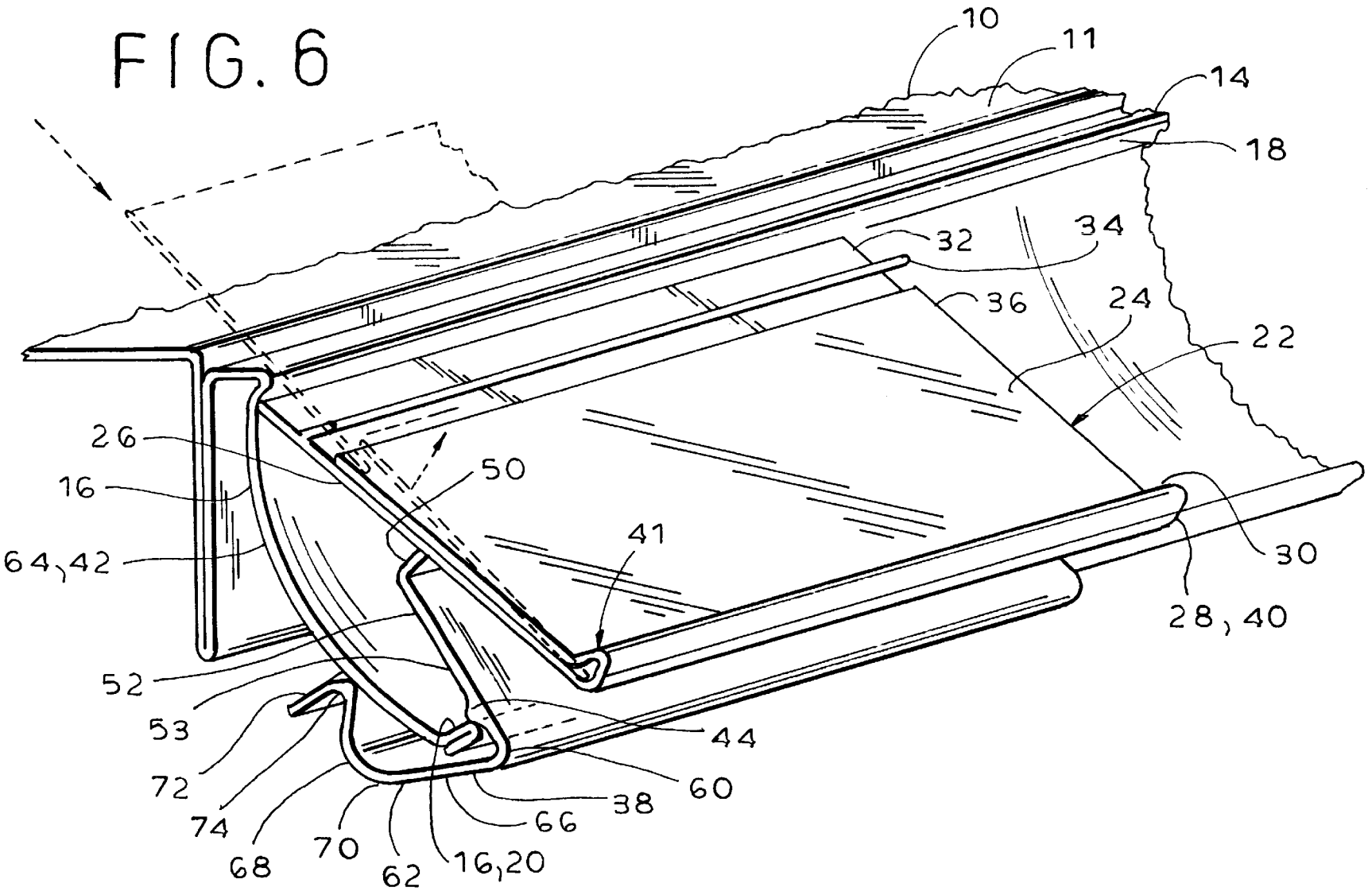
FIG. 6 is a perspective view of the label holder mounted on a shelf channel, from the front, showing the front panel being opened by pressure applied to the bottom of the label holder.

Referring to FIG. 6, when the label holder 22 is mounted, the top 36 of the front panel 24 can be urged open (i.e., away from the back panel 26) by directing downward and/or rearward pressure (e.g., with a finger) on the bottom 28 of the label holder 22, as indicated by the arrow 41. This facilitates the insertion and replacement of label within the pocket formed by the front and back panels. When such pressure is applied to the bottom 28 of the label holder 22, the back panel 26 flexes, or bows, about a fulcrum point created at the junction point between the back panel 26 and the base portion 50 of the shelf channel clip 38. The top 36 of the front panel 24, being unattached from the back panel 26, displaces, or moves away, from the back panel forming an opening through which a label can be inserted or replaced.

Figure 7:
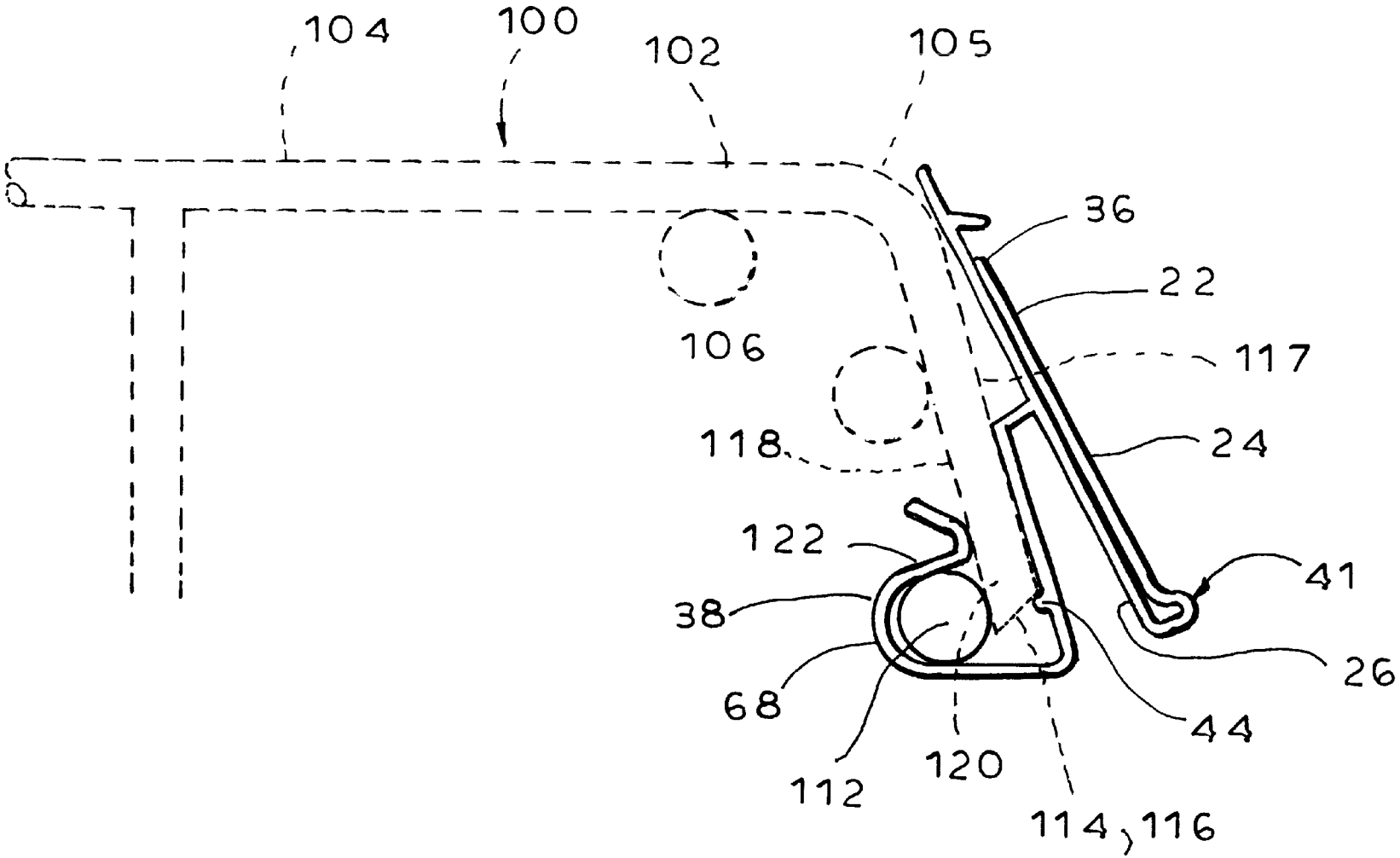
FIG. 7 is a side elevational view of the label holder of the present invention mounted on a wire shelf.

Referring to FIG. 7, the label holder 22 is also designed to mount on certain wire shelves, which are formed of interconnected (e.g., welded), typically cylindrical, wire elements. The wire shelf 100 depicted includes a plurality of generally horizontal upper wire elements 102 which extend from the front to the back of the shelf. Each upper wire element 102 includes a product-supporting horizontal portion 104, and at least some of the upper wire elements 102 include a front portion 106 which extends downwardly and forwardly, at an inclined angle, from a forward end 108 of the horizontal portion 104 thereof. The upper wire element 102 and the front portion 106 thereof are typically integrally formed from a cylindrical wire.

A transverse wire element 112, having a predetermined radius is interconnected to the underside (or rear surface) of each front portion 106, adjacent an end 114 thereof. Typically, the end 114 of the front portion 106 of the upper wire element 102 has an end face 116 which is downwardly and rearwardly inclined.

When the label holder 22 is mounted on the wire shelf, the clip 38 abuts a front surface 117 of the front portion 106, extends underneath the end 114 thereof, and partially encircles and engages the transverse wire element 112, along a least a top surface 122 thereof. The clip 38 also preferably engages the rear surface 118 of the front portion 106, and resiliently clamps the front portion 106 within the clip 38. Thus, the converging entry gap 120 formed in the clip 38 is preferably narrower than the diameter of the front portion 106 of the upper wire element 102, and a radius of the C-shaped portion 68 of the clip 38 is preferably substantially equal to a radius of the transverse wire element 112. The projection 44 preferably engages the inclined end face 116 of the front portion 106 and preferably does not engage the front surface 116 thereof, such that the clip 38 lies flat against the front surface 116 of the front portion 106 of the upper wire element 102.

As when mounted on a shelf channel, when the label holder 22 is mounted on a wire shelf, the top 36 of the front panel 24 can be urged open (i.e., away from the back panel 26) by directing downward and/or rearward pressure (e.g., with a finger) on the bottom 40 of the label holder 22, as indicated by the arrow 41.

The label holder of the present invention provides an improved label holding structure which is suitable for mounting on shelves having shelf channels of various construction, shapes and sizes. The label holder is convenient to mount and replace and provides an efficient means for inserting and replacing labels. It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed:

1. A label holder mounted on a shelf channel, comprising:

said shelf channel having an intermediate portion with front and rear surfaces and with top and bottom portions;

an top flange extending forwardly from said upper portion of said intermediate portion, and a lower flange extending forwardly from said bottom portion of said intermediate portion;

said label holder having front and back panels interconnected along a common lower edge;

a shelf channel clip extending downwardly and rearwardly from said back panel of said label holder;

a base portion of said shelf channel clip extending rearwardly from said back panel from substantially a middle portion of said back panel;

a lower flange-engaging portion extending downwardly from said base portion;

a shelf channel lower flange-engaging projection extending rearwardly from a rear surface of said lower flange-engaging portion, said shelf channel lower flange-engaging projection contacting an upper surface of said lower flange of said shelf channel, and being sized and shaped to limit downward movement of said label holder with respect to said shelf channel when said label holder is mounted thereon;

a shelf channel rear surface-engaging portion extending rearwardly from a bottom end portion of said lower flange-engaging portion, said shelf channel rear surface-engaging portion contacting said rear surface of said intermediate portion of said shelf channel at a point between said upper and lower flanges of said shelf channel;

said shelf channel rear surface-engaging portion having a rearwardly depending portion extending rearwardly from said bottom end portion of said lower flange-engaging portion;

a forwardly-facing C-shaped portion having a lower portion connected to a rearward end of said rearwardly depending portion of said shelf channel rear surface-engaging portion, said C-shaped portion having an opening facing said rear surface of said intermediate portion of said shelf channel;

an upper end of said front panel of said label holder being displaceable forwardly from said back panel upon the application of rearward pressure on a lower portion of said label holder when said label holder is mounted on said shelf channel to facilitate the insertion and removal of an information label; and said shelf channel clip being resiliently deformable to accommodate and mount to shelf channels of various configurations.

2. The label holder mounted on a shelf channel of claim 1, further comprising a guide flange extending rearwardly from an upper end of said C-shaped portion, said guide flange forming a converging entry gap with said lower flange-engaging portion to assist in the mounting of said label holder on said shelf channel.

3. A label holder mounted on a shelf channel, comprising:

said shelf channel having an intermediate portion with front and rear surfaces and with top and bottom portions;

an upper flange extending forwardly from said top portion of said intermediate portion, and a lower flange extending forwardly from said bottom portion of said intermediate portion;

said label holder having front and back panels interconnected along a common lower edge;

a shelf channel clip extending downwardly and rearwardly from said back panel of said label holder;

a base portion of said shelf channel clip extending rearwardly from said back panel from a point substantially equidistant said common lower edge of said front and back panels, and a top edge of said back panel, said base portion being substantially perpendicular to said back panel;

a lower flange-engaging portion extending downwardly from said base portion to a point substantially on a plane passing through said common lower edge of said front and back panels and perpendicular to said back panel;

a shelf channel lower flange-engaging projection extending rearwardly from a rear surface of said lower flange-engaging portion, said shelf channel lower flange-engaging projection contacting an upper surface of said lower flange of said shelf channel, and being sized and shaped to limit downward movement of said label holder with respect to said shelf channel when said label holder is mounted thereon;

a shelf channel rear surface-engaging portion extending rearwardly from a bottom end portion of said lower flange-engaging portion, said shelf channel rear surface-engaging portion contacting said rear surface of said intermediate portion of said shelf channel at a point between said upper and lower flanges of said shelf channel;

said shelf channel rear surface-engaging portion having a rearwardly depending portion extending rearwardly from said bottom end portion of said lower flange-engaging portion;

a forwardly-facing C-shaped portion having a lower portion connected to a rearward end of said rearwardly depending portion of said shelf channel rear surface-engaging portion, said C-shaped portion having an opening facing said rear surface of said intermediate portion of said shelf channel; and an upper end of said front panel of said label holder being displaceable forwardly from said back panel upon the application of rearward pressure on a lower portion of said label holder when said label holder is mounted on said shelf channel to facilitate the insertion and removal of an information label; and, said shelf channel clip being resiliently deformable to accommodate and mount to shelf channels of various configurations.

4. The label holder mounted on a shelf channel of claim 3, further comprising a guide flange extending rearwardly from an upper end of said C-shaped portion, said guide flange forming a converging entry gap with said lower flange-engaging portion to assist in the mounting of said label holder on said shelf channel.

* * * * *